United States Patent [19]

Prager

[11] 4,149,331

[45] Apr. 17, 1979

[54] FRAME FOR DISPLAYING PHOTOGRAPHS OR THE LIKE

[76] Inventor: Jack Prager, 1555 Francisco St., San Francisco, Calif. 94123

[21] Appl. No.: 817,700

[22] Filed: Jul. 21, 1977

[51] Int. Cl.[2] ..... G09F 1/12

[52] U.S. Cl. ..... 40/152; 40/124.2; 40/16

[58] Field of Search ..... 40/209, 159, 64, 152, 40/17, 16 R, 16.2, 16.4, 16.6, 152.1, 10 A, 124.2

[56] References Cited

U.S. PATENT DOCUMENTS

| | | | |
|---|---|---|---|
| 359,316 | 3/1887 | Damlos | 40/152 |
| 1,611,465 | 12/1926 | Leskiewizc et al. | 40/152 |
| 1,821,053 | 9/1931 | Dietz et al. | 40/209 X |
| 2,659,991 | 11/1953 | Strayer | 40/152 X |
| 3,648,393 | 3/1972 | Parrilla | 40/152 |
| 4,009,796 | 3/1977 | Schmidt | 220/345 |
| 4,041,630 | 8/1977 | Holbrook | 40/152.1 |

FOREIGN PATENT DOCUMENTS

| | | | |
|---|---|---|---|
| 1195510 | 6/1959 | Fed. Rep. of Germany | 40/152 |

*Primary Examiner*—Louis G. Mancene
*Assistant Examiner*—Wenceslao J. Contreras
*Attorney, Agent, or Firm*—Phillips, Moore, Weissenberger, Lempio & Majestic

[57] ABSTRACT

A rectangular frame comprises parallel upper and lower sections secured to parallel first and second side sections. Each of the upper, lower and first side sections has an elongated groove defined on an inner side thereof to further define generally C-shaped composite mounting grooves adapted to retain a photograph or the like therein. An elongated slot is formed through the second side section to extend substantially the full length thereof whereby the photograph may be inserted through the slot and disposed in the frame for display purposes. A rail, co-extensive with respect to the second side section and slidably mounted thereon, covers the slot to retain the photograph in position on the frame.

8 Claims, 5 Drawing Figures

FRAME FOR DISPLAYING PHOTOGRAPHS OR THE LIKE

BACKGROUND OF THE INVENTION

Photographs are normally displayed in a rectangular frame having a slot formed through one side thereof to facilitate insertion of the photograph into the frame. A backing cover is normally pressed against a back side of the photograph to hold it in position, either by wire fasteners secured to the frame or by frictional engagement as between complexity frame, photograph and backing. In addition to the relative complxity of such a frame arrangement and display procedure, the photograph is subjected to damage, such as bending, when mounted in the frame.

SUMMARY OF THIS INVENTION

An object of this invention is to provide an economical and non-complex frame adapted to have a photograph or the like inserted therein and removed therefrom expeditiously. The frame is preferably rectangular and comprises upper and lower sections disposed in parallel relationship and a first side section secured between first ends of the upper and lower sections. An elongated groove is defined on an inner side of each of the upper, lower and first side sections with the grooves defined in the upper and lower sections intersecting opposite ends of the groove defined in the first side section to further define generally C-shaped composite mounting grooves for the photograph.

A second side section, disposed in parallel relationship relative to the first side section, is secured between second ends of the upper and lower sections. An elongated slot is formed through the second side section to extend substantially the full length thereof and intersects the grooves defined in the upper and lower sections. Thus, a photograph or the like may be inserted through the slot and slid into the C-shaped composite mounting grooves defined in the frame to display the photograph.

The slot is closed to retain the photograph in the frame by a removable rail which is co-extensive with the second side section of the frame. The rail is preferably slidably mounted on the second side section by a tongue and groove arrangement.

BRIEF DESCRIPTION OF THE DRAWINGS

Other objects of this invention will become apparent from the following description and accompanying drawings wherein.

DETAILED DESCRIPTION

Figure 1:
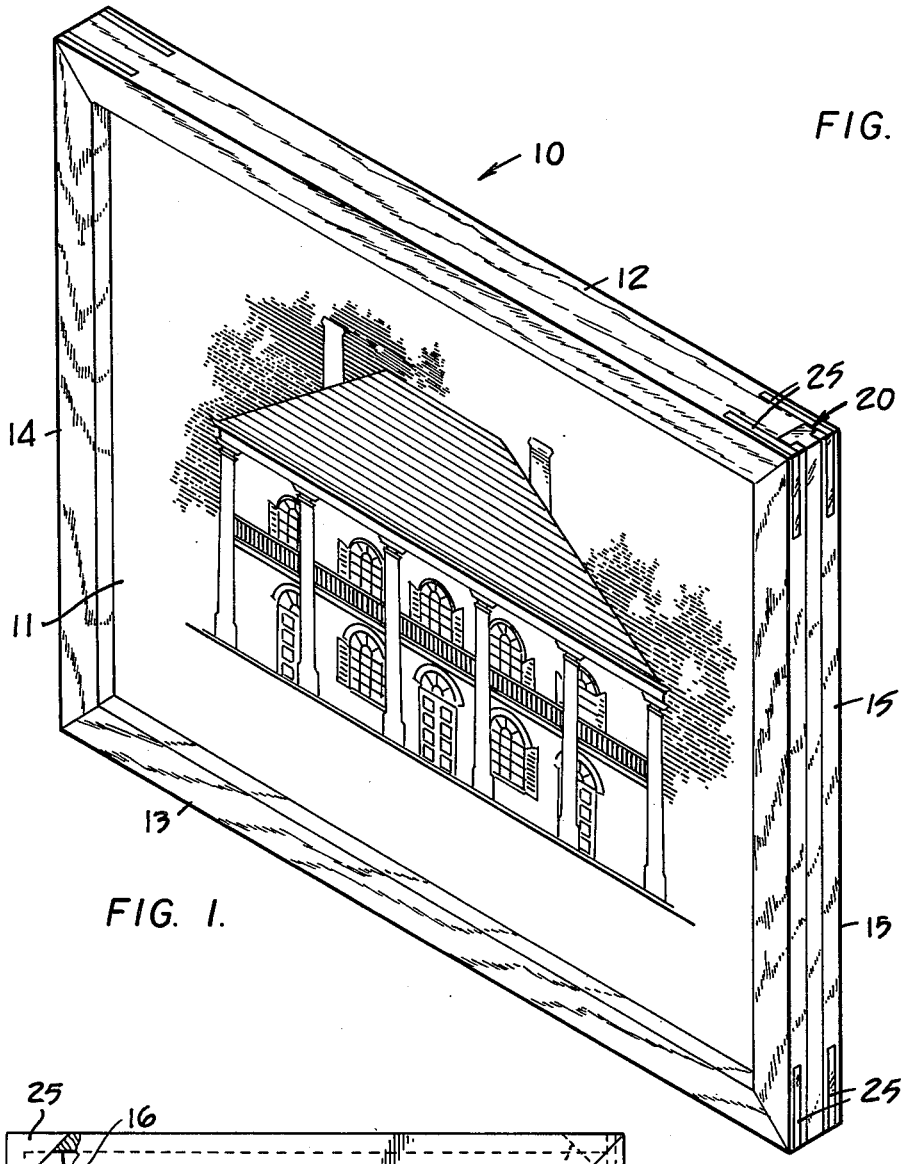
FIG. 1 is an isometric view schematically illustrating a frame embodying this invention adapted to mount and display a photograph therein.

FIG. 1 illustrates an open frame 10 adapted to have at least one photograph or the like 11 inserted therein for display purposes. The frame comprises an upper section 12 and a lower section 13 disposed in parallel relationship relative to the upper section. A first side section 14 is secured between first ends of the upper and lower sections with each section 12–14 being substantially identical to each other.

A second side section 15 is disposed in parallel relationship relative to first side section 14 and is secured between second ends of the upper and lower sections. The frame is thus open to display photograph 11 and is rectangular in configuration to be substantially coextensive therewith. The sections of the frame may be formed individually out of wood, plastic, metal or other suitable framing material and secured together at their corners by standard miter joints. Alternatively, the frame may be formed as a composite one-piece structure by conventional molding technique, for example.

Figure 4:
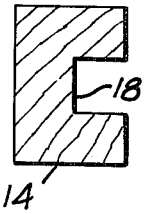
FIG. 4 is an enlarged sectional view of one of the sections of the frame, taken in the direction of arrows IV—IV in FIG. 1.
Figure 2:
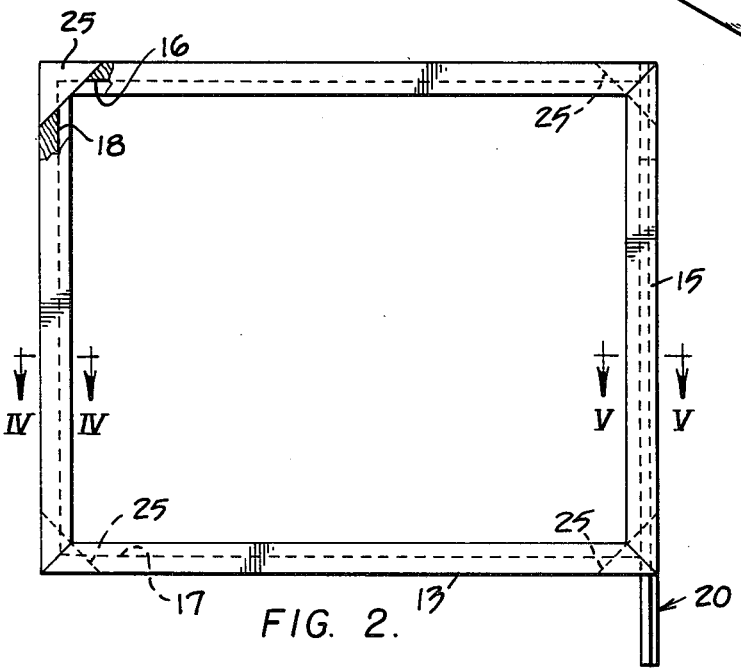
FIG. 2 is a reduced plan view of the frame.
Figure 3:
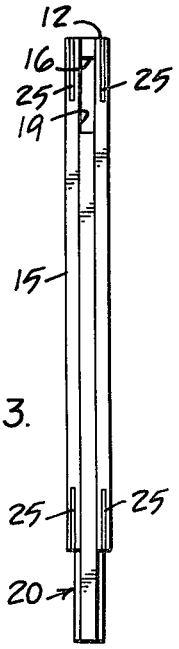
FIG. 3 is an end elevational view of the frame, taken in the direction of arrows III—III in FIG. 2, but showing a rail partially removed from the frame.

As more clearly shown in FIGS. 2–4, elongated grooves 16, 17 and 18 are defined on inner sides of each of the upper, lower and first side sections, respectively. Grooves 16 and 17, defined in each of the upper and lower sections, intersect opposite ends of groove 18 defined in the first side section to further define generally C-shaped composite mounting grooves for retaining three sides of photograph 11 therein. As more clearly shown in FIG. 4, each individual groove is generally U-shaped to form a channel member which is preferably constructed to provide a slight clearance relative to a respective edge of the photograph to aid in the insertion and removal functions. If so desired, the width of the groove may be constructed to accommodate two photographs in back-to-back relationship to expose the photographs on both sides of the frame.

Referring to FIGS. 1 and 3, second side section 15 has an elongated slot 19 formed therethrough to extend substantially the full length thereof. Opposite ends of the slot intersect grooves 16 and 17 of the upper and lower sections of the frame and has a linear dimension slightly greater than the height of photograph 11. Thus, the photograph may be inserted through slot 19 and slid into C-shaped composite mounting grooves 16–18 for display purposes.

Figure 5:
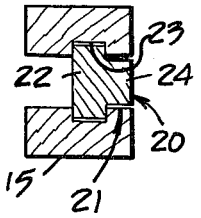
FIG. 5 is an enlarged sectional view of another section of the frame and further iilustrating a tongue and groove arrangement for mounting the rail on the frame.

FIGS. 1 and 5 illustrate a rail 20 slidably mounted in second side section 15 by a tongue and groove arrangement 21 to retain photograph 11 in position in the frame. As shown in FIG. 5, the tongue and groove arrangement comprises a tongue 22 slidably mounted in a groove 23, both of which have a T-shaped cross section and are suitably sized to retain the rail in position on second side section 15 by frictional engagement. The rail is co-extensive with the second side section and has a flat outer side 24 to which is disposed in flush relationship relative to an outer side of the second side section.

As shown in FIGS. 1 and 3, a pair of wedge-shaped reinforcing members 25 are secured in notches suitably formed on either side of groove 23, at each corner of the frame whereat second side section 15 meets upper and lower sections 12 and 13. Such reinforcing members increase the structural integrity of the corners of the frame, particularly during formation of groove 23 thereof. Similar reinforcing members are preferably secured to the remaining two corners of the frame whereat first side section 14 meets the upper and lower sections.

From the above description, it can be seen that at least one photograph 11 may be expeditiously inserted in and removed from the frame which, when inserted therein, is substantially coextensive therewith for retention and protection purposes. Removable rail 20 will retain the photograph in position in the frame and is suitably mounted thereon, as described above, to retain the overall continuity and smooth appearance of the frame.

I claim:

1. A frame for displaying photographs or the like comprising an upper section, a lower section disposed in parallel relationship relative to said upper section, a first side section secured between first ends of said upper and lower sections, means defining an elongated groove on an inner side of each of said upper and lower sections, a second side section disposed in parallel relationship relative to said first side section and secured between second ends of said upper and lower sections to define a rectangular album frame, means defining an elongated slot through said second side section which extends at least substantially the full length thereof, opposite ends of said slot intersecting the grooves defined in said upper and lower sections whereby a photograph or the like may be inserted through said slot and slid into said grooves for display purposes, an elongated straight rail having a longitudinal axis and extending at least substantially the full length of said second side section to cover said slot, and means comprising a groove extending at least substantially the full length of said second side section and a tongue formed on an inner side of said rail slidably mounting said rail in said groove on said second side section for linear and sliding movement in the direction of said longitudinal axis from an open position exposing said slot and a closed position covering said slot and for locking said rail to said frame to prevent outward movement of said rail relative to said frame, transversely of said longitudinal axis and said linear movement, when said rail is in its closed position, said groove and said tongue each having a T-shaped cross section.

2. The frame of claim 1 further comprising an elongated groove formed on an inner side of said first side section defining C-shaped composite mounting grooves with the grooves defined in said upper and lower sections.

3. The frame of claim 2 wherein each of said upper, lower, first side and second side sections are each constructed as an individual channel member with respective corners of said channel members being secured together at miter joints.

4. The frame of claim 1 wherein said album frame constitutes a one-piece composite structure.

5. The frame of claim 1 further comprising a display article disposed in the grooves defined in said upper and lower sections, said frame and said display article each being rectangular and substantially coextensive with respect to each other.

6. The frame of claim 1 wherein an outer side of said rail is at least substantially disposed in flush relationship relative to an outer side of said second side section.

7. The album of claim 1 further comprising a pair of reinforcing members disposed on either side of said groove at each corner of said frame whereat said second side section meets said upper and lower sections.

8. A frame for displaying photographs or the like comprising an upper section, a lower section disposed in parallel relationship relative to said upper section, a first side section secured between first ends of said upper and lower sections, means defining an elongated groove on an inner side of each of said upper and lower sections, a second side section disposed in parallel relationship relative to said first side section and secured between second ends of said upper and lower sections to define a rectangular album frame, means defining an elongated slot through said second side section which extends at least substantially the full length thereof, opposite ends of said slot intersecting the grooves defined in said upper and lower sections whereby a photograph or the like may be inserted through said slot and slid into said grooves for display purposes, an elongated straight rail having a longitudinal axis and extending at least substantially the full length of said second side section to cover said slot, means comprising a groove extending at least substantially the full length of said second side section and a tongue formed on an inner side of said rail slidably mounting said rail in said groove on said second side section for linear and sliding movement in the direction of said longitudinal axis from an open position exposing said slot and a closed position covering said slot and for locking said rail to said frame to prevent outward movement of said rail relative to said frame, transversely of said longitudinal axis and said linear movement, when said rail is in its closed position, and a pair of reinforcing members disposed on either side of said groove at each corner of said frame whereat said second side section meets said upper and lower section.

* * * * *